US010240439B2

(12) United States Patent
Noffke et al.

(10) Patent No.: US 10,240,439 B2
(45) Date of Patent: Mar. 26, 2019

(54) RUNNING TOOL AND LINER HANGER CONTINGENCY RELEASE MECHANISM

(71) Applicant: Halliburton Energy Services, Inc., Houston, TX (US)

(72) Inventors: Richard Paul Noffke, Frisco, TX (US); Arthur Terry Stautzenberger, Denton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 394 days.

(21) Appl. No.: 15/032,270

(22) PCT Filed: Jan. 8, 2014

(86) PCT No.: PCT/US2014/010748
§ 371 (c)(1),
(2) Date: Apr. 26, 2016

(87) PCT Pub. No.: WO2015/105487
PCT Pub. Date: Jul. 16, 2015

(65) Prior Publication Data
US 2016/0251945 A1 Sep. 1, 2016

(51) Int. Cl.

| | |
|---|---|
| ***E21B 43/10*** | (2006.01) |
| ***E21B 23/01*** | (2006.01) |
| ***E21B 31/107*** | (2006.01) |
| ***E21B 43/12*** | (2006.01) |
| ***E21B 17/046*** | (2006.01) |

(52) U.S. Cl.
CPC ..... *E21B 43/10* (2013.01); *E21B 17/046* (2013.01); *E21B 23/01* (2013.01); *E21B 31/107* (2013.01); *E21B 43/12* (2013.01)

(58) Field of Classification Search
CPC ..... E21B 43/10; E21B 23/01; E21B 31/107; E21B 43/12; E21B 17/046
See application file for complete search history.

(56) References Cited

U.S. PATENT DOCUMENTS

| | | | | |
|---|---|---|---|---|
| 4,311,194 | A | 1/1982 | White | |
| 4,598,774 | A * | 7/1986 | Nevels | E21B 23/02 166/124 |
| 5,191,936 | A | 3/1993 | Edwards et al. | |
| 6,241,018 | B1 | 6/2001 | Eriksen | |
| 8,393,389 | B2 | 3/2013 | Brisco et al. | |

FOREIGN PATENT DOCUMENTS

| | | |
|---|---|---|
| EP | 1600600 | 11/2005 |

OTHER PUBLICATIONS

International Search Report and Written Opinion issued by the Korean Intellectual Property Office regarding related International Application No. PCT/US2014/010748, dated Oct. 14, 2015, 14 pages.

* cited by examiner

*Primary Examiner* — Wei Wang
(74) *Attorney, Agent, or Firm* — Haynes & Boone, LLP

(57) ABSTRACT

A running tool for installing a liner in a wellbore of the type which can be disconnected from the liner by applying a weight down condition to the tool and rotating the work string in the right-hand direction.

19 Claims, 15 Drawing Sheets

RUNNING TOOL AND LINER HANGER CONTINGENCY RELEASE MECHANISM

CROSS REFERENCE TO RELATED APPLICATIONS

None.

DESCRIPTION

Technical Field

A liner running tool that provides and contingency release from the liner hanger and method are provided for positioning a liner in a well bore and then release the tool from the liner hanger.

Background

In petroleum production, completion is the process of making a well ready for production (or injection). This principally involves preparing the bottom of the hole to the required specifications, running in the production tubing and its associated down hole tools as well as perforating and stimulating as required. Typically, the process of running in and cementing the casing is also included.

Typically, a lower completion liner is set across the productive zone using a liner hanger system to anchor this lower completion to the casing or production casing string. A liner hanger is a device used in oil fields to hang liners within an oil well. Liners can be installed mechanically or hydraulically, depending on the well using a running tool.

Liner running tools typically feature subassemblies that connect to and then release from the liner hanger when the liner is in place in the well. The system's running tools feature clutch and premium tool joint connections that transmit high-torque throughout the liner system while rotating, and are capable of carrying the heavy loads generated by the long assemblies and heavy liners.

Expandable liner hangers are generally used to secure a liner within a previously set casing or liner string. These types of liner hangers are typically set by expanding the liner hangers radially outward into gripping and sealing contact with the previous casing or liner string. Many such liner hangers are expanded by use of hydraulic pressure to drive an expanding cone or wedge through the liner hanger, but other methods may be used (such as mechanical swaging, explosive expansion, memory metal expansion, swellable material expansion, electromagnetic force-driven expansion, etc.).

The expansion process is typically performed by means of a running tool used to convey the liner hanger and attached liner into a wellbore. The running tool is interconnected between a work string (e.g., a tubular string made up of drill pipe or other segmented or continuous tubular elements) and the liner hanger.

If the liner hanger is expanded using hydraulic pressure, then the running tool is generally used to control the communication of fluid pressure, and flow to and from various portions of the liner hanger expansion mechanism, and between the work string and the liner. The running tool may also be used to control when and how the work string is released from the liner hanger, for example, after expansion of the liner hanger, in emergency situations, or after an unsuccessful setting of the liner hanger.

Furthermore, the running tool is preferably capable of transmitting torque from the work string to the liner, for example, to remediate sticking of the liner in the wellbore, enable the liner to be used as a drill string to further expand the wellbore (in which case a drill bit may be connected to an end of the liner), etc.

It will, thus, be appreciated that many functions are performed by an expandable liner hanger running tool. If these functions are to be performed effectively and reliably, then the operation of the running tool should be appropriately tailored to the environment in which it is to be used.

BRIEF DESCRIPTION OF THE DRAWINGS

The drawing is incorporated into and forms a part of the specification to illustrate at least one embodiment and example of the present design. Together with the written description, the drawing serves to explain the principles of the present design. The drawing is only for the purpose of illustrating at least one preferred example of at least one embodiment of the present design and is not to be construed as limiting the present design to only the illustrated and described example or examples. The various advantages and features of the various embodiments of the present design will be apparent from a consideration of the drawing in which.

DETAILED DESCRIPTION

The present design provides an improved running tool and method for contingency releasing a liner hanger. While the tool is in the run-in condition in the well, with the work string weight off the tool, the liner can be rotated clockwise during the process of positioning the liner and liner hanger in the well. By moving the tubing string to the weight down condition and rotating it in a clockwise direction, the tool can be disconnected from the liner hanger and removed from the well.

It is to be understood that the various embodiments described herein may be utilized in various orientations, such as inclined, inverted, horizontal, vertical, etc., and in various configurations, without departing from the principles of the present disclosure. The embodiments are described merely as examples of useful applications of the principles of the disclosure, which is not limited to any specific details of these embodiments.

In the following description of the representative embodiments of the disclosure, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore. As used herein, terms describing the relationship of the tubing strings and the running tool, such as, weight-down, compression loaded, tension loaded, tensile loaded is used to describe the forces applied to the tool by the work string. If the liner hanger has been expanded to engaged with the wellbore or is stuck in the wellbore and the weight of the work string is at least partially applied against the upper coupling of the running tool then the running tool is in compression. When the weight of the tool is supported from the tool string, the tool will itself be in tension. When a portion of the liner or liner hanger is stuck in the well and the work string is tensioned the running tool will be in tension. In the attached drawings the direction along the well string toward the Earth's surface is to the left hand side of the page when viewed in landscape. Note that, in this specification, the terms "liner" and "casing" are used interchangeably to describe tubular materials which are used to form protective linings in wellbores. Liners and casings may be made from any material (such as metals, plastics, composites, etc.), may be expanded or unexpanded as part of an installation procedure, and may be segmented or continuous. It is not necessary for a liner or casing to be cemented in a wellbore. Any type of liner or casing may be used in keeping with the principles of the present disclosure.

Figure 1:
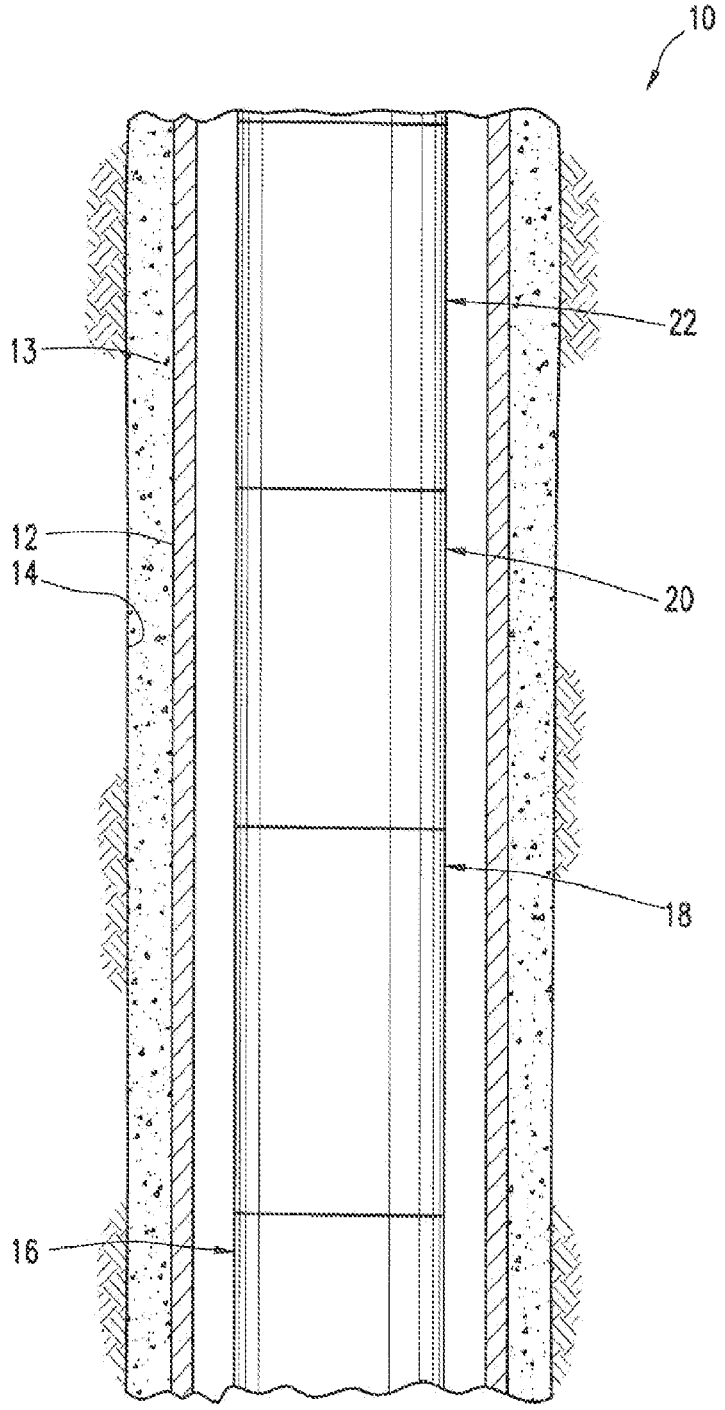
FIG. 1 is a diagram view of liner hanger and running tool connected to a work string illustrating a liner being run into a wellbore.

Representatively illustrated in FIG. 1 is a liner hanger setting system 10 and associated method which embody principles of the present disclosure. In this system 10, a casing string 12 has been installed and cemented within a wellbore 14. It is now desired to install a liner 16 extending outwardly from a lower end of the casing string 12, in order to further line the wellbore 14 at greater depths.

As depicted in FIG. 1, an expandable liner hanger 18 is used to seal and secure an upper end of the liner 16 near a lower end of the casing string 12. Alternatively, the liner hanger 18 could be used to seal and secure the upper end of the liner 16 above a window (not shown in FIG. 1) formed through a sidewall of the casing string 12, with the liner extending outwardly through the window into a branch or lateral wellbore. Thus, it will be appreciated that many different configurations and relative positions of the casing string 12 and liner 16 are possible in keeping with the principles of the disclosure.

A running tool 20 is connected between the liner hanger 18 and a work string 22. The work string 22 is used to convey the running tool 20, liner hanger 18 and liner 16 into the wellbore 14, conduct fluid pressure and flow, transmit torque, tensile and compressive force, etc. The running tool 20 is used to facilitate conveyance and installation of the liner 16 and liner hanger 18, in part by using the torque, tensile and compressive forces, fluid pressure and flow, etc. delivered by the work string 22.

The method of installing a liner in a wellbore using the present run in tool 20, comprises releasably connecting a liner running tool 20 to a liner hanger 18 and a liner 16. As is illustrated in the accompanying Figures, the releasable connection comprises telescoping a portion of the liner running tool 20 into a central bore of the liner hanger 18 such that relative rotation between the liner running tool 20 and liner hanger 18 is prevented. A releasable axial locking mechanism maintains the liner running tool 20 telescoped into the liner hanger 18. Connecting the assembly to a work string 22 such that that right hand rotation and torque applied to the running tool 20 can be conveyed from the running tool 20 to the liner hanger 18 and liner 16. Lowering the assembly into position in the wellbore while applying tension and right hand rotation to the running tool, as needed, through the work string. Radially expanding the liner hanger 18 to engage the wellbore and connect the liner 16 to the wellbore. Actuating the locking mechanism to release the running tool 20 from the liner hanger 18 so that the running tool 20 can be removed from the wellbore with the work string 22. Alternatively, if the liner 16 and liner hanger 18 become stuck in the wellbore before the liner hanger 18 is expanded, releasing the running tool 20 from the liner hanger 18 and removing the running tool 20 from the wellbore with the work string. The releasing step comprises applying compression and right hand rotation to the running tool 20 to actuate the locking mechanism.

At this point, it should be specifically understood that the principles of the disclosure are not to be limited in any way to the details of the system 10 and associated methods described herein. Instead, it should be clearly understood that the system 10, methods, and particular elements thereof (such as the running tool 20, liner hanger 18, liner 16, etc.) are only examples of a wide variety of configurations, alternatives, etc. which may incorporate the principles of the disclosure.

Referring now to FIGS. 2-16, detailed cross-sectional views of successive axial portions of the liner hanger 18 are representatively illustrated. These figures depict a specific configuration of one embodiment of the liner hanger 18, but many other configurations and embodiments are possible without departing from the principles of the disclosure. The liner hanger 18 and running tool 20 are shown in these figures in the configuration in which they are conveyed into the wellbore 14. The work string 22 is attached to the running tool 20 at an upper threaded connection 28, and the liner 16 is attached to the liner hanger 18 at a lower threaded connection when the overall assembly is conveyed into the wellbore 14.

Figure 2:
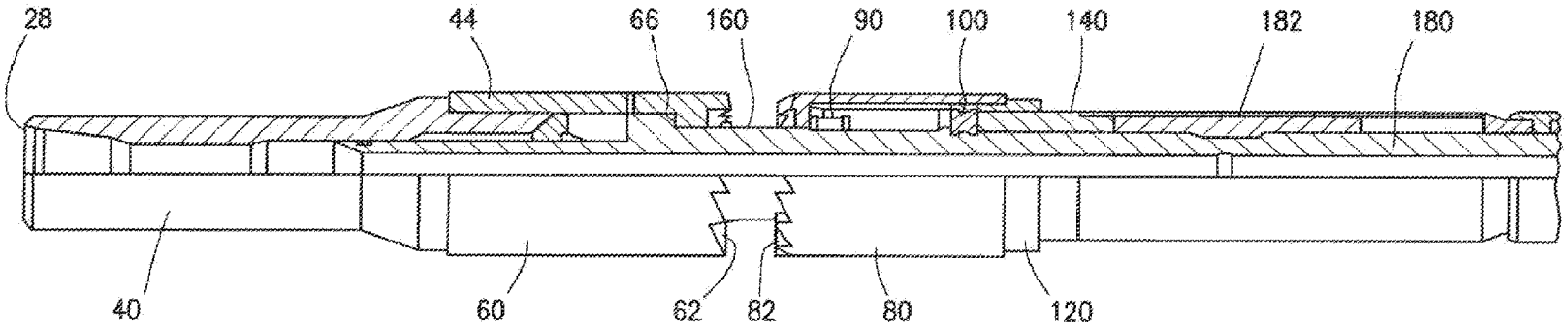
FIGS. 2-7 are section views of the upper portion of the running tool as it would be in tension connected to a liner and supported from the work string and in the run-in configuration.
Figure 3:
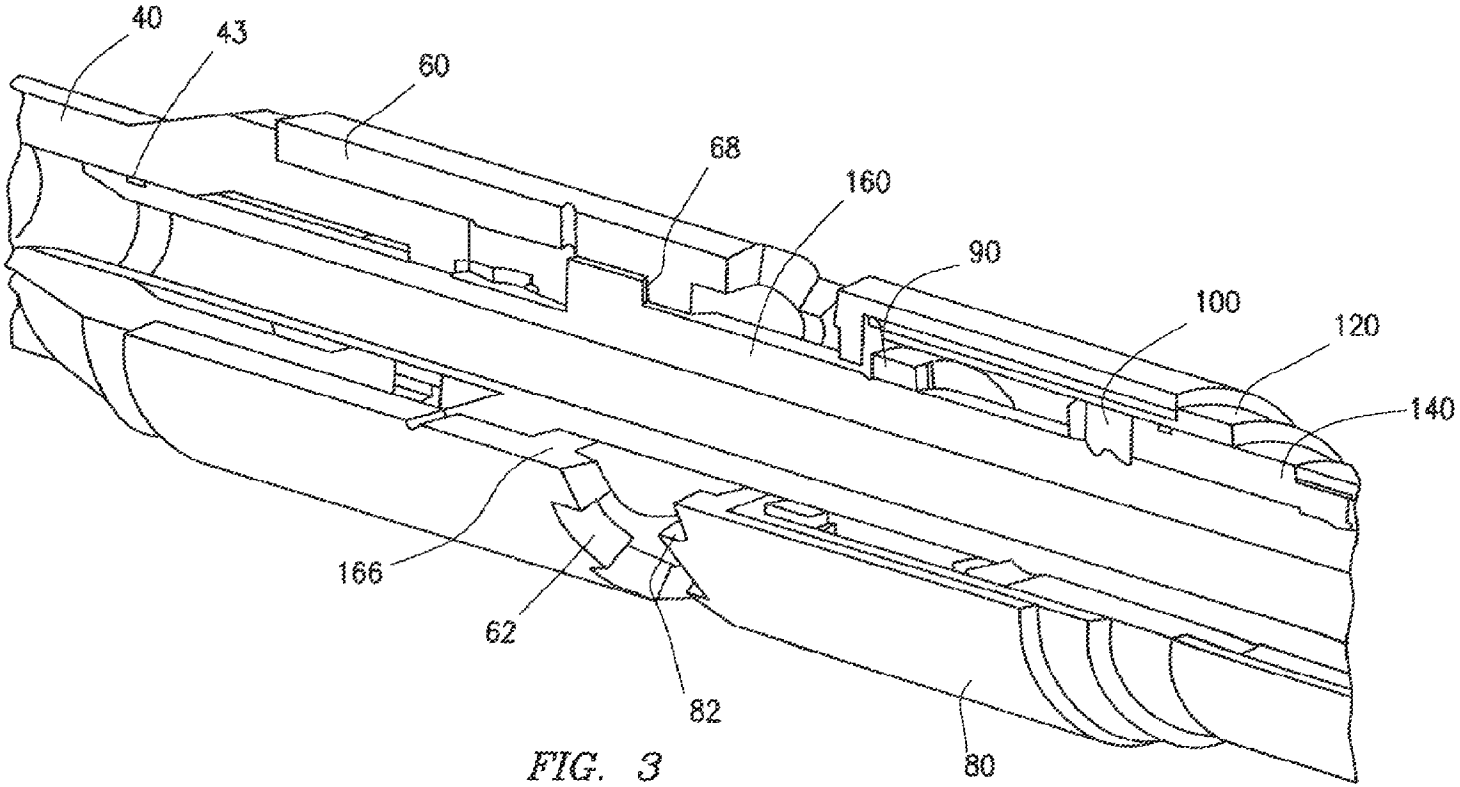
Figure 4:
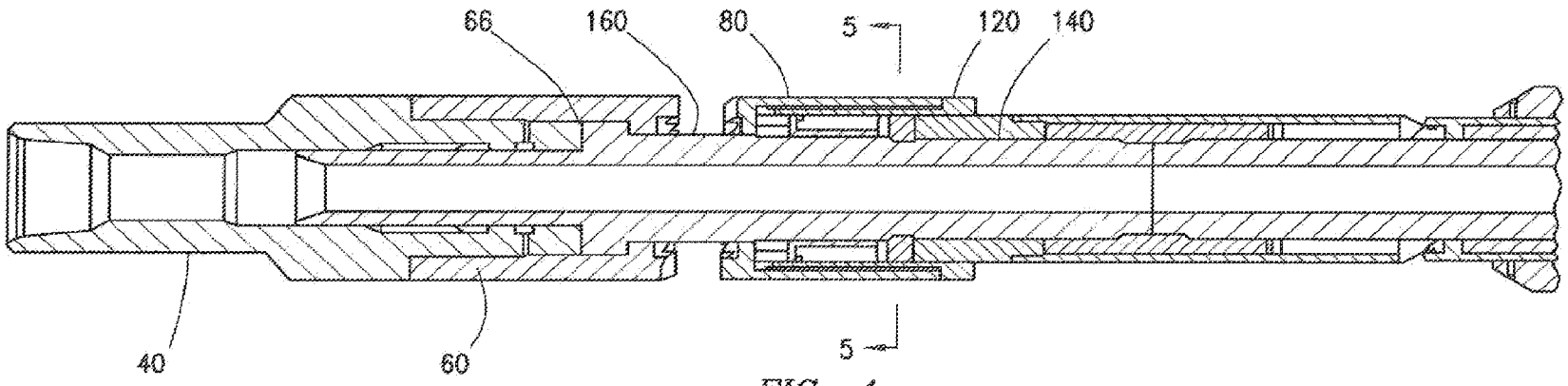

In FIGS. 2-7 the detail construction of the upper portion of the liner hanger running tool 20 illustrated in tension when in the run-in condition. In FIGS. 2-4 the well head (or up-hole direction) is to the left side of these figures. The running tool 20 is made up of several subassemblies, including an upper coupling 40, upper clutch sleeve 60, lower clutch sleeve 80, nut 90, locking dogs 100, sleeve 120, dog cage 140, upper mandrel 160, lower mandrel 180 and outer housing 184.

Figure 14:
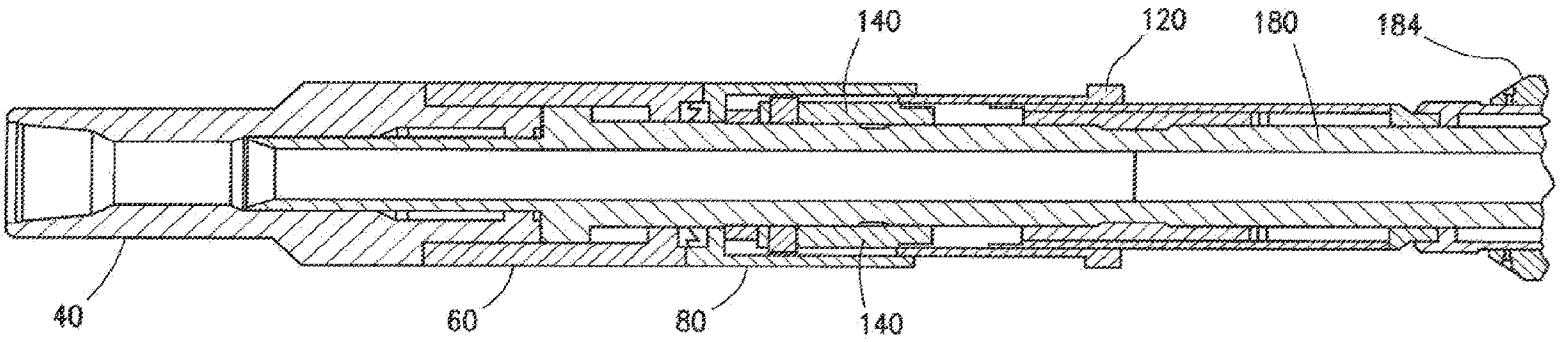
Figure 15:
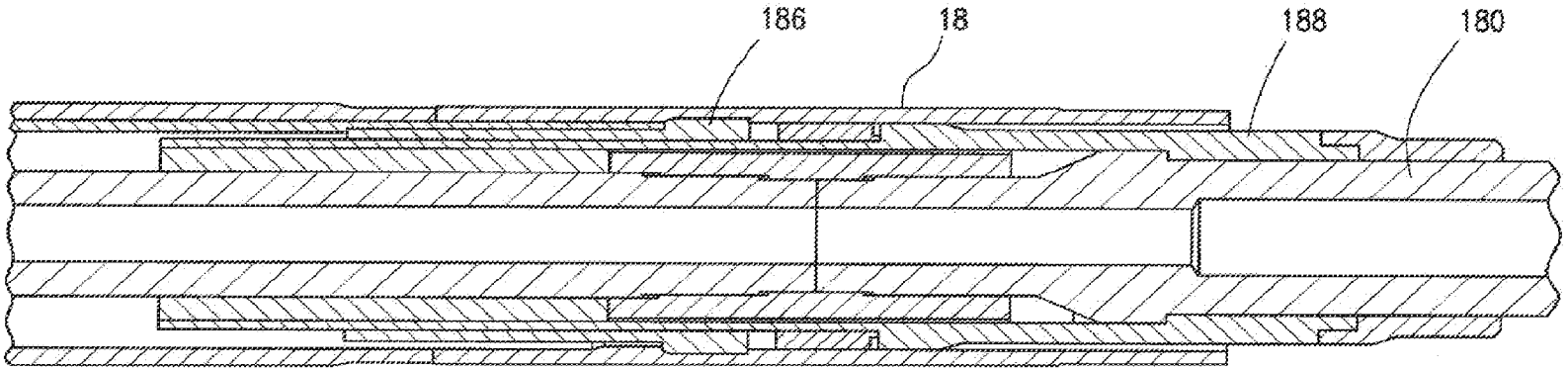
FIG. 15 is a partial section view of the lower portion of the running tool illustrating the collet in the lower portion of the running tool.

As illustrated and described in reference to FIGS. 14 and 15, the bottom end of liner running tool 20 is telescoped into a central bore of the liner hanger 18. Relative rotation between the liner running tool and liner hanger is prevent by engaged splines and slots on the tool and hanger. A locking mechanism releasably connected to a liner hanger 18 by preventing relative axial movement. As will be described in detail, the locking mechanism comprises numerous elements that function together to release the running tool 20 from the liner hanger 18. The locking mechanism involves, in part, moving the lower mandrel 180 axially with respect to the outer housing 184.

The upper coupling 40 is a tubular shaped member. Upper coupling 40 comprises a upper threaded connection 28 to connect the running tool 20 (and the liner hanger and liner) to a work string for the purpose of positioning and installing the liner in the well at a subterranean location. The mandrel 160 is positioned to extend into the upper coupling 40 and to rotate with respect thereto when compression is applied by the work string. An annular seal 43 provides a rotating seal between the mandrel 160 and the interior of the upper coupling 40. The lower end of the upper coupling 40 has an externally threaded portion 44. The generally cylindrical shaped upper clutch sleeve 60 has internal threads which mate with the threaded portion 44 of the upper coupling 40 to attach the clutch sleeve 60 to the upper coupling 40. It is envisioned of course the other means for attaching these two elements together could be used, such as, welding, pins or the like. The inside lower end of the clutch sleeve 60 forms a upward facing shoulder 68. A plurality of ratchet shaped clutch teeth 62 are formed on the lower facing end. As is illustrated the mandrel 160 has an increased diameter portion 166 that retains the mandrel within the clutch sleeve 60 by the engagement of adjacent annular shoulders 66. Nut 90 is connected to the exterior of the mandrel 160 by threads, pins, snap rings or the like.

Figure 6:
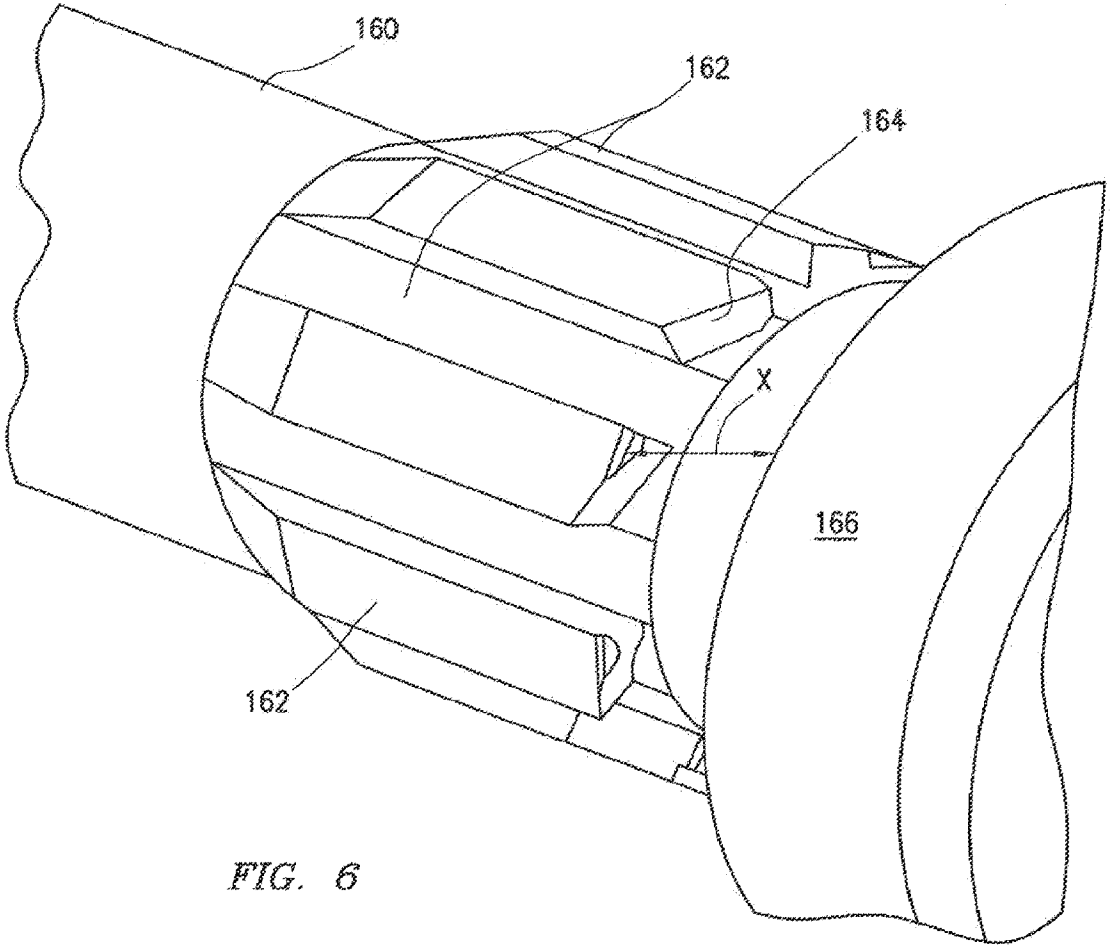
Figure 7:
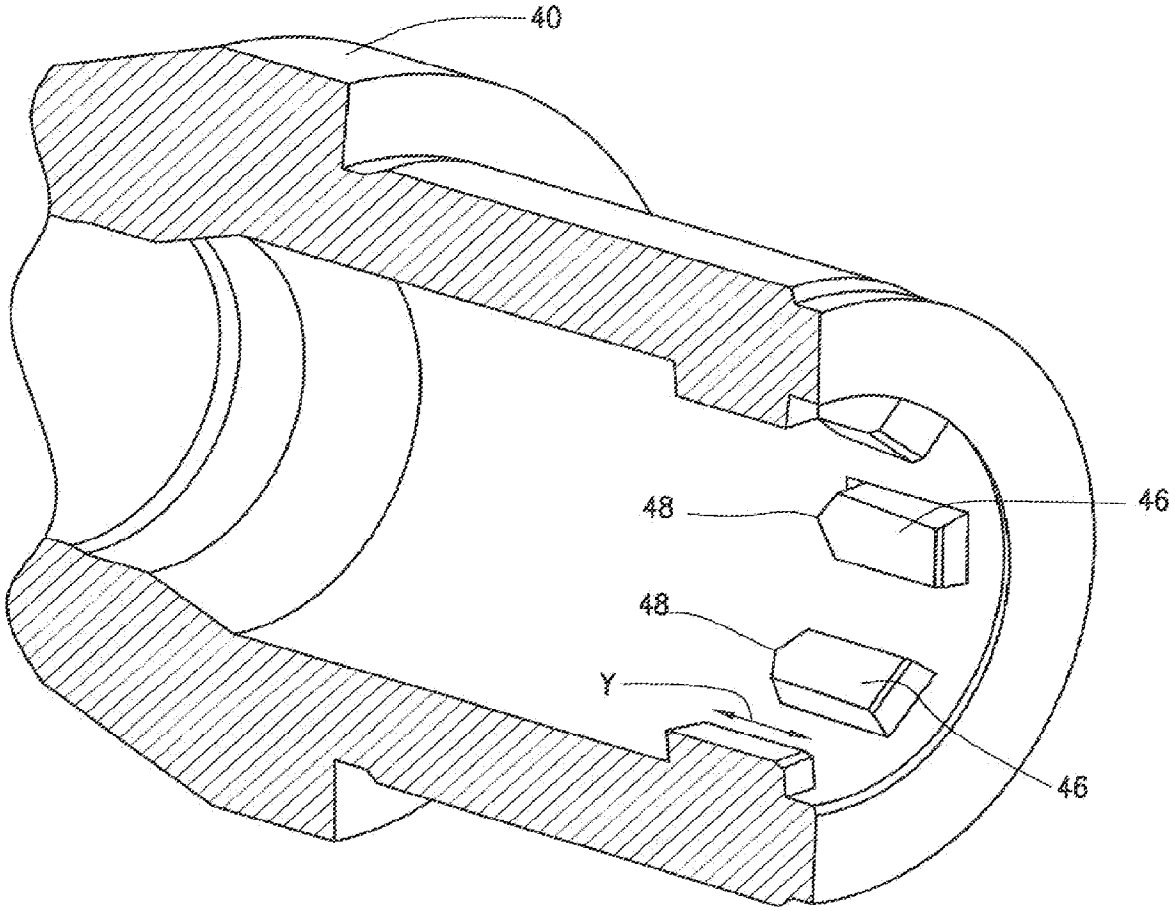

As illustrated in FIG. 6, a plurality of circumferentially spaced axially extending splines 162 are mounted adjacent the left-hand or upper end of mandrel 160. As illustrated in FIG. 7, a plurality of circumferentially axially extending splines 46 are formed on the interior of the upper coupling 40. The spacing and size of the splines 46 and 162 allow the splines to mesh and transmit torque applied by the work string through the upper coupling 42 the mandrel 160. Also as Illustrated in FIG. 7 the upward facing ends 48 of the splines 46 form a ramp surfaces for enhancing axial meshing with the splines 162. Accordingly, the downward facing ends 164 are tapered to enhance meshing with the splines 46 by contact with the upward facing ends 48 on splines 46.

As is illustrated in the splines 162 does not extend axially to the enlarged portion up to 166. As can be best seen in FIG. 6, splines 162 terminate a distance X from the upward face of the enlarged portion 166. As best illustrated in FIG. 7, splines 142 extend axially a distance Y. In the illustrated embodiment the distance lie is less than the distance X. When the running tool 18 is supported in the wellbore in the run in configuration illustrated in FIG. 2, splines 42 and 162 are engaged and the mandrel 160 rotates with the work string and upper coupling 40. Although not illustrated the mandrel 160 is coupled at its lower end to the liner. This engagement or meshing of the splines allows the running tool 18 to be lowered into the well and rotated to position the liner as necessary in the wellbore.

Figure 8:
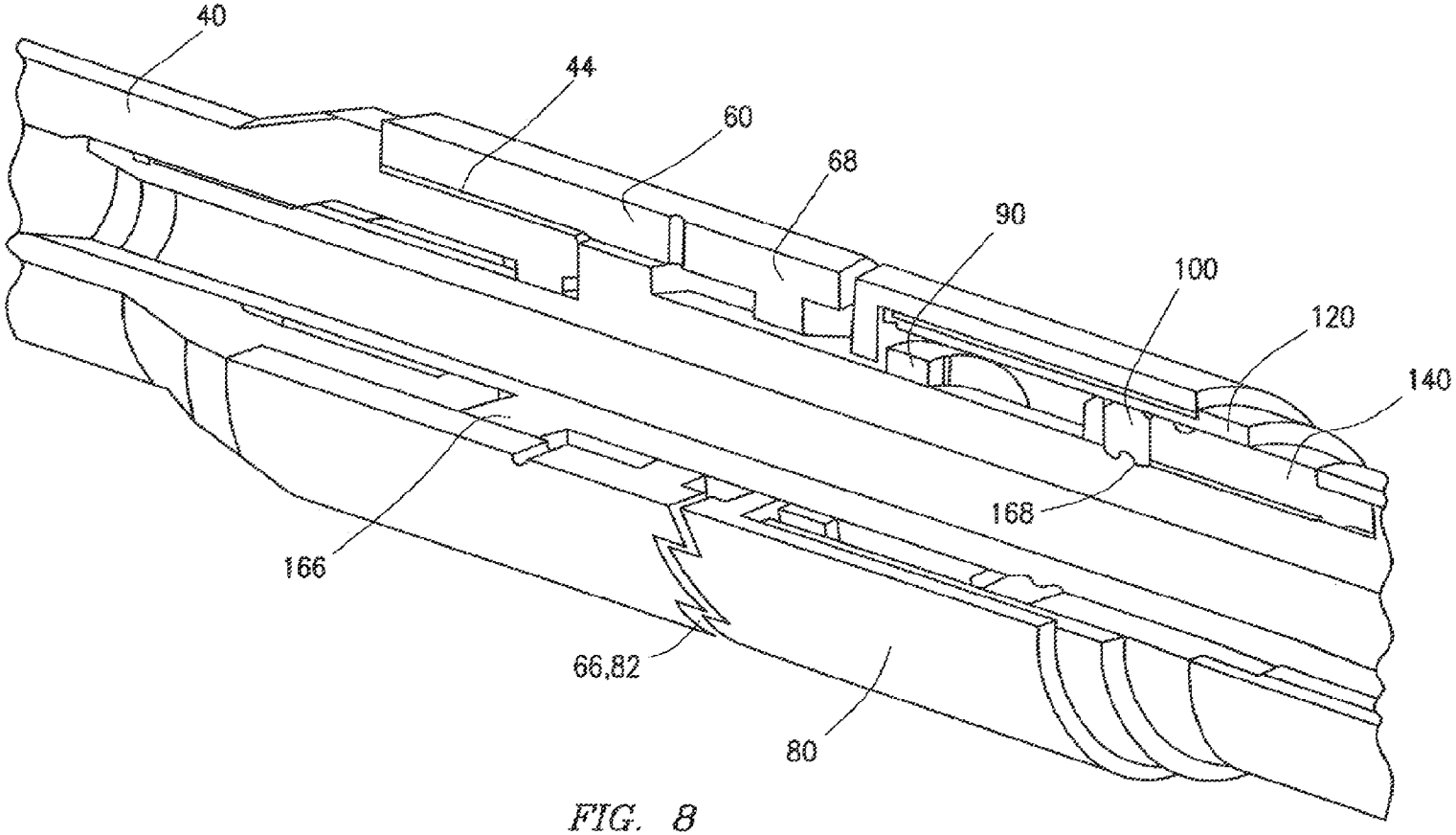
FIGS. 8-10 are section views of the upper portion of the running tool in compression with the clutch engaged.

When however, the tubing work string weight is set down on the running tool 18 as illustrated in FIG. 8, splines 42 have moved axially downward to disengage from splines 162. In this weight down position, right-hand rotation of the tubing work string will rotate with respect to the mandrel 160. Upper mandrel 160 and lower mandrel 180 are connected together by a coupling 182. A lower clutch sleeve 80 and tubular dog cage assembly 140 surround the mandrel 160 along its length extending below the upper coupling 40 and upper clutch sleeve 60. The dog cage assembly 140 is shouldered to the housing 184 and prevents movement upwards when dogs 100 are locked in place. Housing 184 extends axially down to the liner hanger 200 connected to the lower end the running tool. Dog cage assembly 140 is splined to mandrel 160.

In the position illustrated in FIGS. 2-7, the work string 12, running tool 20 and liner 16 can be raised lowered and rotated in the right hand direction to maneuver the liner into position in the well. Torque is transferred to the assembly to allow rotation by meshing the splines 46 and 162.

The upper end of the clutch sleeve 80 has upward facing clutch teeth 82 of a size and shape to mesh with clutch teeth 62. When the running tool is in the position illustrated in FIG. 8, the teeth mesh and engage to allow right-hand rotation to be transmitted from upper clutch sleeve 62 to the lower clutch sleeve 80. According to the present embodiment the clutch teeth 62 and 82 are profiled such that they act as a ratchet, slipping once left-hand rotation is applied and engaging in transmitting torque when right-hand rotation is applied.

Figure 5:
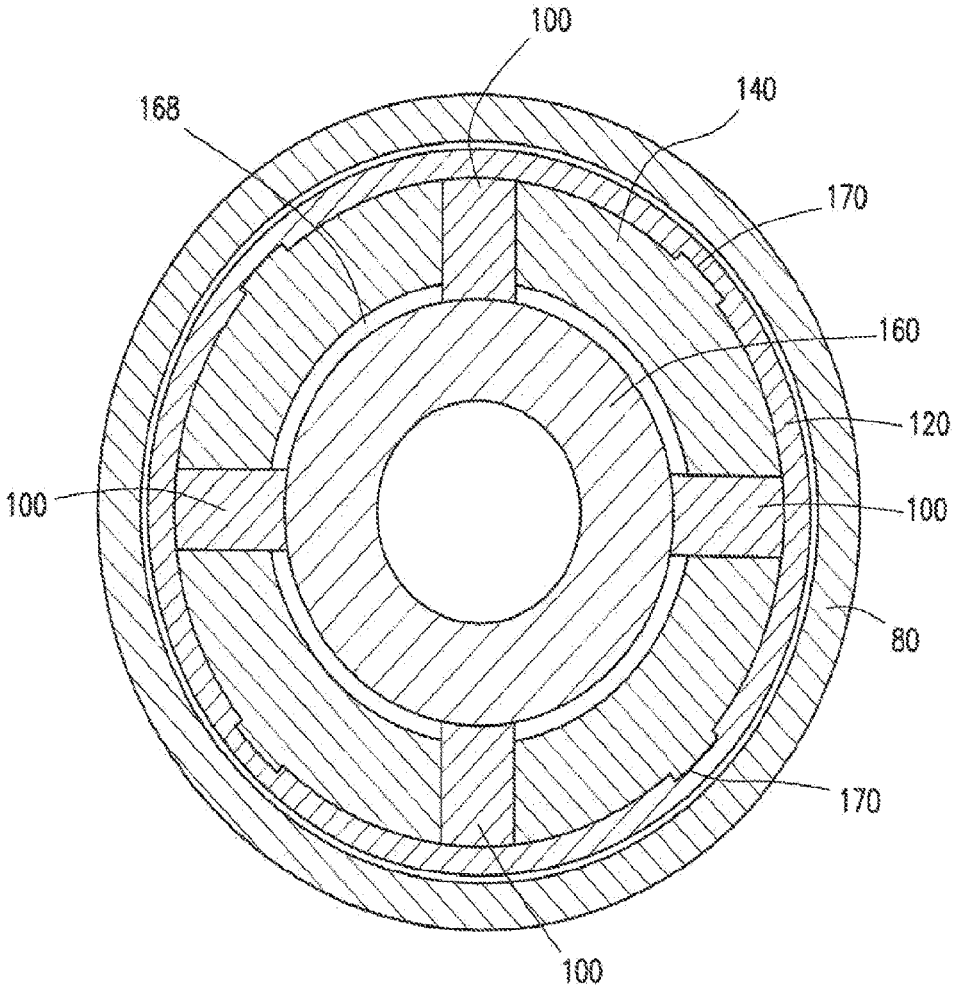

As will be described in more detail, mandrels 160 and 180 are held against axial movement with respect to the dog cage 140 housing 184 and lower portion of the running tool 18 by a plurality of dogs 100 engaging annular grooves 168 in the exterior of the mandrel 160. As illustrated in FIG. 5, the dogs 100 are held in radially engagement with the grooves 168 by a cylindrical dog prop 120. Dog prop 120 has a plurality of axially extending slots which engage axially extending splines 170 on the exterior surface of dog cage assembly 140. Splines 170 prevent relative rotation between the dog prop 120 and dog cage 140.

The exterior surface of the dog prop 120 and the mating interior surface of the lower clutch sleeve 80 are threaded. Right hand rotation on the lower clutch sleeve 80 with respect to the dog prop 120, will cause the dog prop 120 to move axially downward with respect to the dogs 100. As will be explained, when the dog prop 120 moves axially downward a sufficient distance to be out of contact with the dogs 100, dogs 100 are free to move radially out of engagement with the annular grooves 168 to free the mandrel 160 to move axially with respect to the dog cage 140 and housing 184.

Figure 9:
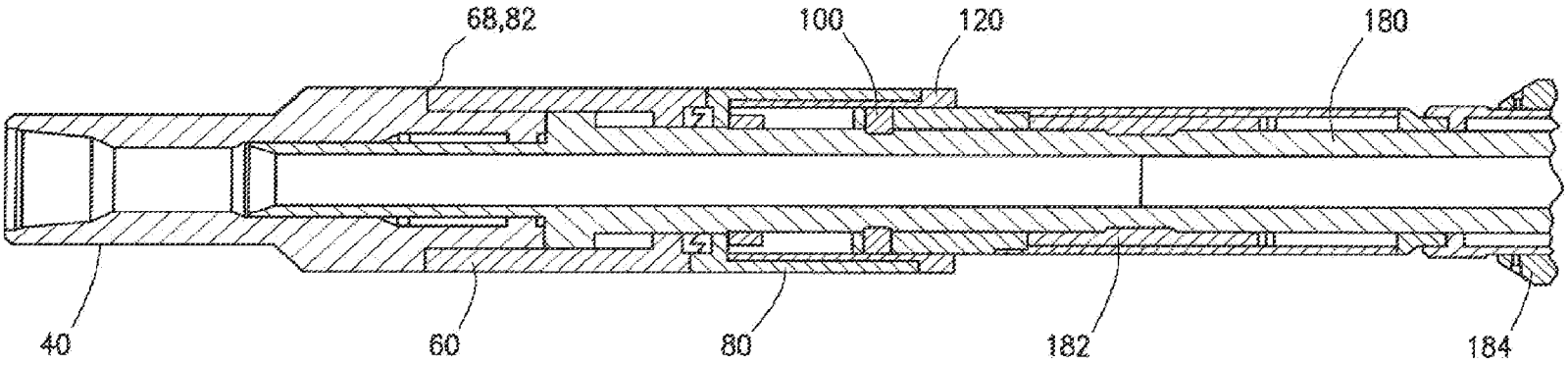

Moving dog prop 120 out of contact with dogs 100 will be describe by reference to FIGS. 8 and 9. In FIGS. 8 and 9, tool 20 is illustrated in the weight-down position or in compression. This state is accomplished when the liner 16 is supported axially in the wellbore and the work string is lowered until the upper coupling 40 and upper clutch sleeve 60 move axially with respect to the lower clutch sleeve 80. In this position, illustrated in FIGS. 8 and 9, splines 46 and 162 are disengaged allowing the coupling 40 and upper clutch sleeve 60 to rotate with respect to the mandrel 160. In this position, clutch teeth 62 and 82 have become engaged to transmit right hand rotation to lower clutch sleeve 80.

Figure 10:
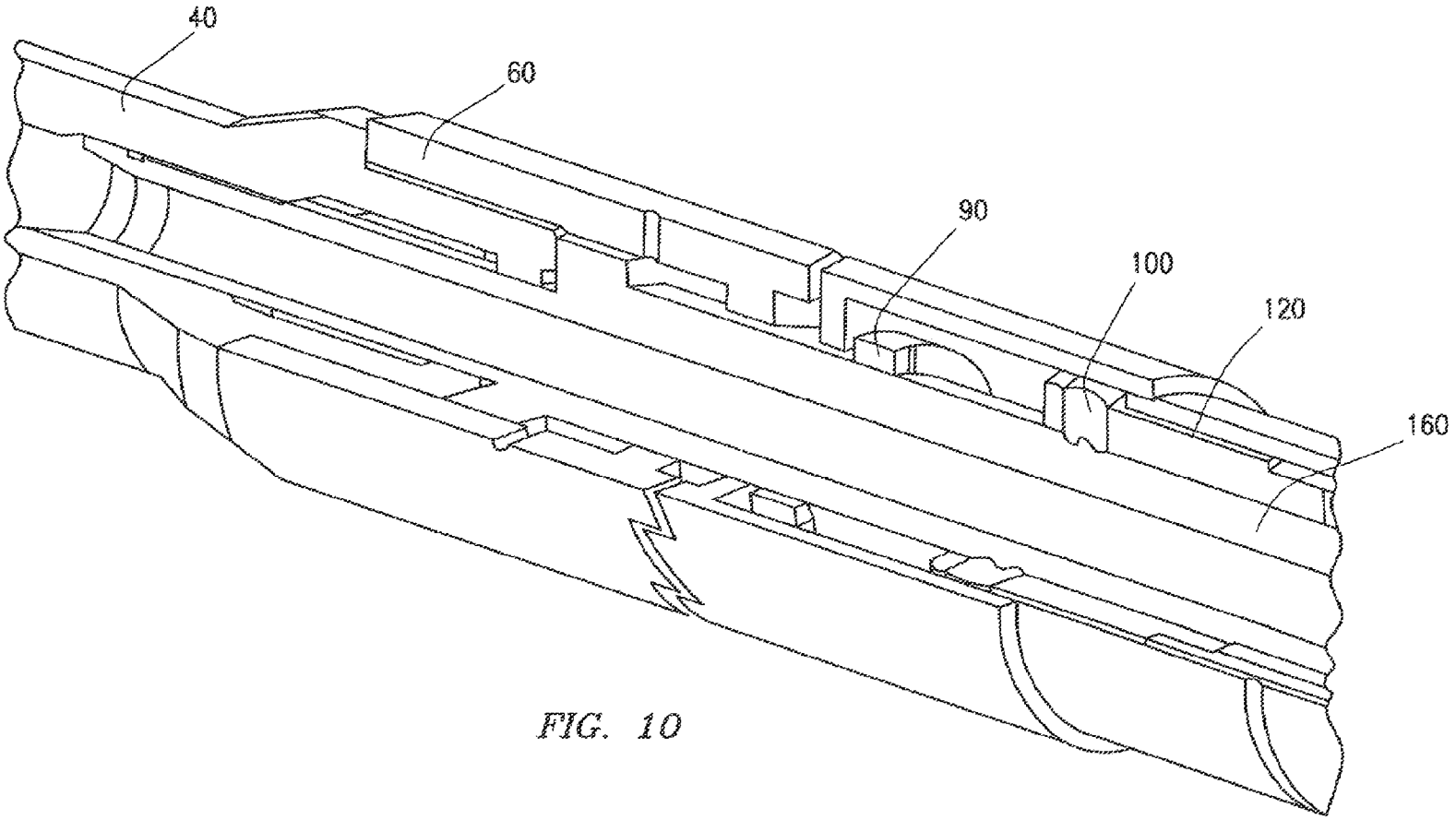
Figure 11:
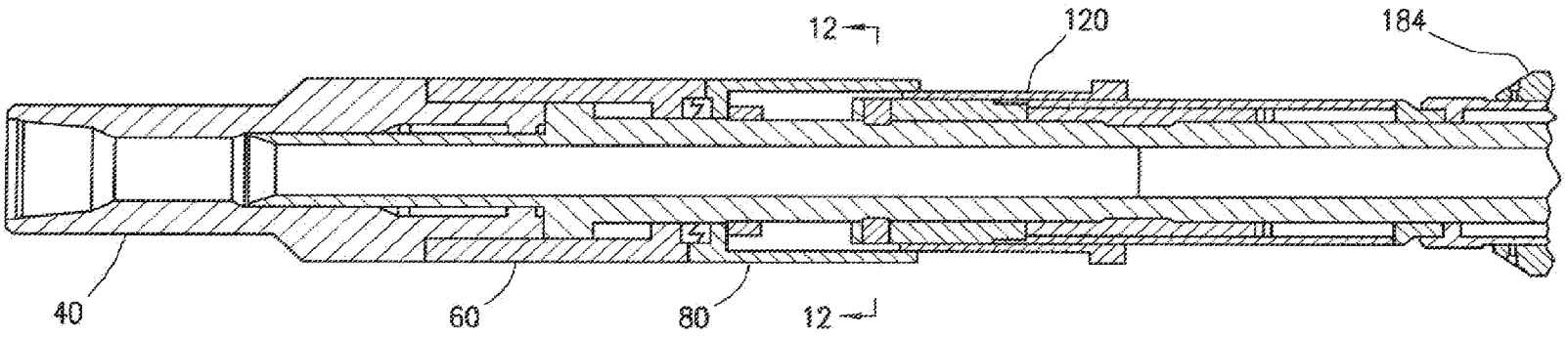
FIGS. 11-12 are enlarged partial section views of the upper portion of the running tool with the clutch engaged and with the dog prop separated from the locking dogs.
Figure 12:
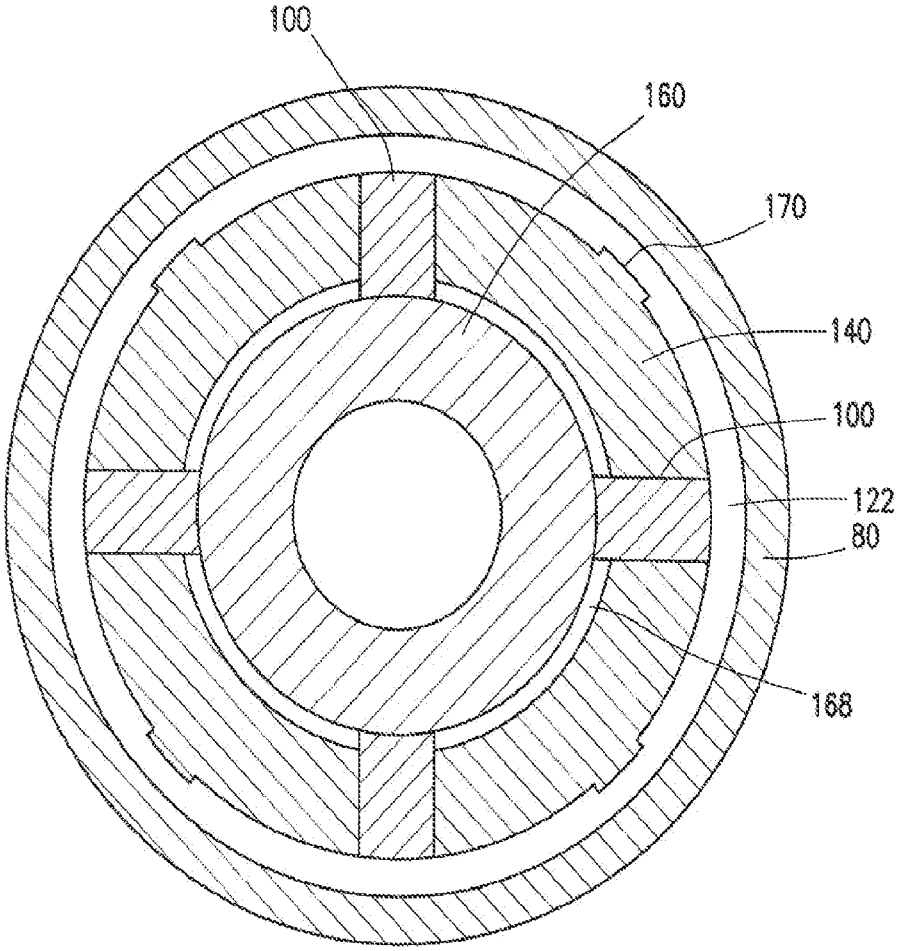
Figure 13:
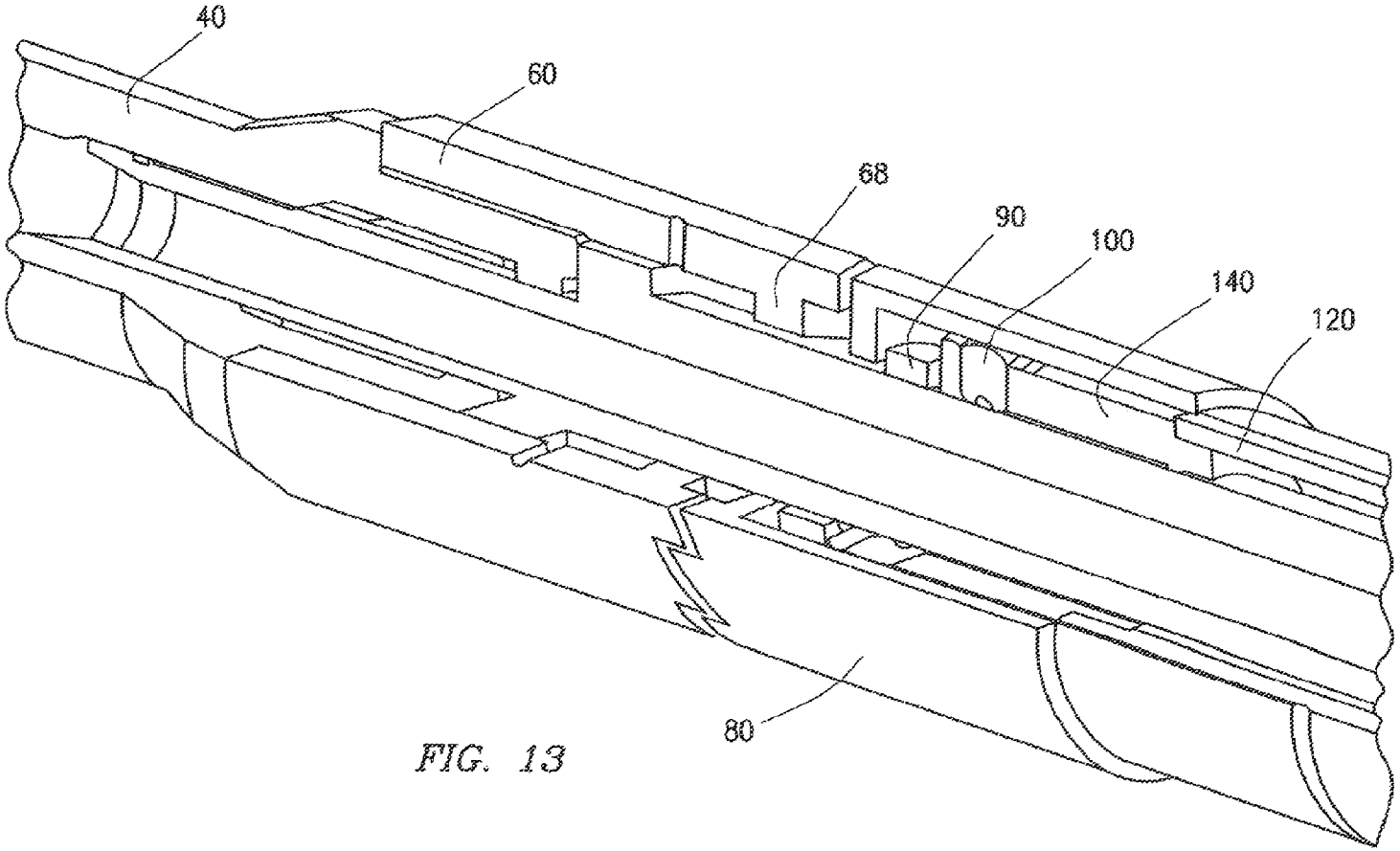
FIGS. 13-14 are enlarged partial section views of the upper portion of the running tool with the mandrel advanced downward in the upper portion of the running tool to un-prop the collet in the lower portion of the liner hanger.

FIGS. 10-12 illustrate the dog prop 120 moved axially downward to a position out of contact with the dogs 100 by right-hand rotation of the upper coupling 40. With the dog prop 120 in this position an annular space 122 is opened up between the dogs 100 and lower clutch sleeve 80. Once the space is opened up dogs 100 can move radially outward allowing the mandrel to move downward with respect to the housing 182. In FIGS. 13 and 14 the tool is illustrated with the mandrel moved axially downward until nut 90 contacts the upper end of dog cage 140.

The lower end of the running tool 20 and its releasable connection to the liner hanger is illustrated in FIG. 15. A collet 186 on the lower mandrel 180 is propped in to an annular slot in the liner hanger to releasable connect to the liner. As the lower mandrel 180 is shifted downward as described in the previous figures, a lower collet prop 188 moves axially away from the collet 186 freeing the collet to disengage from the annular slot in the liner hanger. Disengaging the collet 186 disconnects the running tool 20 from the liner hanger 18 allowing the running tool 20 to be removed from the wellbore.

By using this running tool 20, a liner can be moved into position in the well by raising, lowering and turning the work string. To disconnect the running tool 20 on the liner 16, the work string can be lowered to a weight down condition on the tool, right-hand rotation applied to the work string to disconnect the tool on the liner. The running tool can then be removed from the well leaving the liner in place.

In one or more embodiments, the methods described here and elsewhere herein are disclosed and support method claims submitted or which may be submitted or amended at a later time. The acts listed and disclosed herein are not exclusive, not all required in all embodiments of the disclosure, can be combined in various ways and orders, repeated, omitted, etc., without departing from the spirit or the letter of the disclosure. For example, disclosed is an exemplary method of releasing a liner running tool from a liner hanger while located at a subterranean location in a wellbore, the method comprising: Claim 1 providing a liner running tool; releasably connecting a liner running tool to a liner hanger and liner to form a liner assembly; connecting a liner assembly to a tubing string; inserting the tubing string and assembly into a wellbore and moving the liner assembly to a subterranean location; and releasing the liner running tool from the liner hanger, the releasing step comprising moving the tubing string to apply compression to the liner running tool followed by rotating the tubing string in the right-hand direction. Also, Claim 2, the method according to Claim 1, comprising radially outwardly expanding at least a portion of the liner hanger in the wellbore before the step of releasing the running tool from the liner hanger. Additionally, Claim 3, the method according to Claim 1 or 2, wherein inserting the tubing string and liner assembly in the wellbore additionally comprises maintaining the liner running tool releasably connected to the liner hanger while rotating the tubing string and liner assembly and simultaneously maintaining the running tool in tension. Further, Claim 4, the method according to Claims 1-3, wherein releasably connecting the running tool to the liner hanger and liner, comprises telescoping a portion of the liner running tool into a central bore in the liner hanger. In addition, Claim 5, the method according to Claims 1-4, wherein releasably connecting comprises a collet engaging surfaces on the liner running tool and liner hanger to limit relative axial movement between the between the liner hanger and running tool. Even further Claim 6, the method according to Claims 1-5 wherein releasably connecting step comprises engaging surfaces on the liner hanger and running tool to limit relative rotation between the liner hanger and running tool. Even more, Claim 7, the method according to Claim 1, 2, 3, 4, 5, or 6, wherein the liner running tool provision comprises providing an elongated tool body having one end adapted for connection to a work string and the other end adapted for connection to a liner hanger; a clutch in the body movable between a first position when the liner running tool is in tension wherein rotation and torque is transmitted between the ends of the body and a second position when the liner running tool is in compression wherein rotation and torque is not transmitted between the ends of the body. Additionally, Claim 8, the method according to Claims 1-7, wherein the liner running tool provision comprises providing an elongated tool body having one end adapted for connection to a work string and the other end adapted for connection to a liner hanger, an axially movable mandrel in the body. In another Claim 9, the method according to Claim 1-8, wherein the step of releasing the liner running tool from the liner hanger comprises shifting the mandrel axially with respect to the liner hanger.

For an even further example, disclosed is an exemplary method for Claim 10, releasing a liner running tool from a liner hanger while located at a subterranean location in a wellbore, the method comprising providing a liner running tool with an elongated body and a clutch in the body movable into and out of an engaged position allowing the ends of the running tool to rotate with respect to each other; releasably connecting an end of the liner running tool to a liner hanger and liner to form a liner assembly; connecting a liner assembly to a tubing string; inserting the tubing string and assembly into a wellbore and moving the liner assembly to a subterranean location; and releasing the liner running tool from the liner hanger, the releasing step comprising moving the tubing string to apply compression to the liner running tool while simultaneously engaging the clutch and rotating the tubing string in right-hand direction. Also, Claim 11, the method of releasing a liner running tool from a liner hanger of Claim 10 wherein providing a liner running tool with a clutch comprises providing a clutch which when the tool is in compression is in the engaged position and transmits rotation to the release mechanism and which when the tool is in the tension is in the disengaged position preventing rotation to the release mechanism but transmits rotation through the liner running tool to the liner.

While compositions and methods are described in terms of "comprising," "containing," or "including" various components or steps, the compositions and methods also can "consist essentially of" or "consist of" the various components and steps. As used herein, the words "comprise," "have," "include," and all grammatical variations thereof are each intended to have an open, non-limiting meaning that does not exclude additional elements or steps.

Therefore, the present designs are well adapted to carry out the objects and attain the ends and advantages mentioned as well as those which are inherent therein. While the invention has been depicted, described, and is defined by reference to exemplary embodiments of the inventions, such a reference does not imply a limitation on the inventions, and no such limitation is to be inferred. The inventions are capable of considerable modification, alteration, and equivalents in form and function, as will occur to those ordinarily skilled in the pertinent arts and having the benefit of this disclosure. The depicted and described embodiments of the inventions are exemplary only, and are not exhaustive of the scope of the inventions. Consequently, the inventions are intended to be limited only by the spirit and scope of the appended claims, giving full cognizance to equivalents in all respects.

Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A method of releasing a liner running tool from a liner hanger while located at a subterranean location in a wellbore, the method comprising the steps of:

providing the liner running tool;

releasably connecting the liner running tool to the liner hanger and a liner to form a liner assembly;

connecting the liner assembly to a tubing string;

inserting the tubing string and the liner assembly into the wellbore and moving the liner assembly to the subterranean location; and releasing the liner running tool from the liner hanger, the releasing step comprising moving the tubing string to apply compression to the liner running tool followed by rotating the tubing string in the right-hand direction;

wherein the step of releasably connecting the running tool to the liner hanger and the liner comprises engaging a collet with surfaces on the liner running tool and the liner hanger to limit relative axial movement between the liner hanger and the running tool.

2. The method according to claim 1, additionally comprising the step of radially outwardly expanding at least a portion of the liner hanger in the wellbore before the step of releasing the running tool from the liner hanger.

3. The method according to claim 1, wherein the step of inserting the tubing string and the liner assembly in the wellbore additionally comprises maintaining the liner running tool releasably connected to the liner hanger while rotating the tubing string and the liner assembly and simultaneously maintaining the running tool in tension.

4. The method according to claim 1, wherein the step of releasably connecting the running tool to the liner hanger and the liner further comprises telescoping a portion of the liner running tool into a central bore in the liner hanger.

5. The method according to claim 1, wherein the step of releasably connecting the running tool to the liner hanger and the liner further comprises engaging surfaces on the liner hanger and the running tool to limit relative rotation between the liner hanger and the running tool.

6. The method according to claim 1, wherein the step of providing the liner running tool comprises providing an elongated tool body having one end adapted for connection to a work string and the other end adapted for connection to the liner hanger; wherein a clutch in the elongated tool body is movable between: a first position when the liner running tool is in tension to permit transmission of rotation and torque between opposing ends of the elongated tool body; and a second position when the liner running tool is in compression to prevent, or at least reduce, transmission of rotation and torque between the opposing ends of the elongated tool body.

7. The method according to claim 1, wherein the step of providing the liner running tool comprises providing an elongated tool body having one end adapted for connection to a work string and the other end adapted for connection to a liner hanger, and an axially movable mandrel in the elongated tool body.

8. The method according to claim 1, wherein the step of releasing the liner running tool from the liner hanger comprises shifting the mandrel axially with respect to the liner hanger.

9. A liner running tool for releasable connection to a work string and a liner hanger to install the liner hanger and a liner at a subterranean location in a wellbore, the running tool comprising:

an elongated body;

one end of the elongated body adapted to be connected to the work string;

a latch on the other end of the elongated body movable into and out of a position releasably connecting the liner hanger to the elongated body;

a clutch in the elongated body movable to a first axial position when the one end of the elongated body is in tension and movable to a second axial position when the one end of the elongated body is in compression, wherein surfaces on the clutch and the elongated body engage and transmit right hand rotation and torque from the one end to the other end of the elongated body when the clutch is in the first axial position, the surfaces on the clutch and the elongated body being of a size and shape to disengage when the clutch is in the second axial position so that right hand rotation and torque applied to the one end is not transmitted to the other end of the elongated body; and a member mounted on the elongated body and adapted to move axially on the elongated body when the elongated body is in compression and right hand rotation is applied to the one end of the elongated body; and a latch member on the other end of the elongated body movable between a position for connecting the liner hanger to the elongated body to a position for disconnecting the elongated body from the liner hanger, the latch being operably associated with the member so that axial movement of the member moves the latch to the position for disconnecting the elongated body from the liner.

10. The liner running tool of claim 9 wherein the latch member comprises a mandrel mounted in the elongated body with a portion of the mandrel exposed at the other end of the elongated body for extension into the liner hanger, the mandrel axially movable to disconnect the elongated body from the liner hanger.

11. The liner running tool of claim 10 wherein the latch member additionally comprises a sleeve on the elongated body mounted to rotate with respect to the other end of the elongated body when the clutch is in the second axial position.

12. The liner running tool of claim 11 wherein the latch member additionally comprises a dog on the elongated body engaging the mandrel to prevent axial movement of the mandrel with respect to the other end of the elongated body.

13. The liner running tool of claim 12 wherein the latch member additionally comprises a dog prop operably associated with the sleeve to move between a first position contacting the dog to hold the dog in a position engaging the mandrel and preventing axial movement of the mandrel and a second position out of contact with the dog permitting the dog to disengage from the mandrel and permit the mandrel to move axially with respect to the second end of the elongated body.

14. The liner running tool of claim 10 in combination with the liner hanger having a central opening of a size and shape to receive the mandrel therein; a collet on the elongated body for releasably engaging the liner hanger; the mandrel movable between a first axial position contacting the collet to hold the collet in engagement with the liner hanger and a second axial position out of contact with the collet to disengage the collet from the liner hanger.

15. The liner running tool of claim 9 wherein the clutch in the elongated body comprises sleeve and shaft; the sleeve and shaft being axially shiftable with respect of each other; axially extending surfaces on the sleeve and shaft in locations and being of a size and shape to engage when the elongated body is in tension and disengage when the elongated body is in compression.

16. The liner running tool of claim 15 wherein the axially extending surfaces comprise axially extending splines.

17. The liner running tool of claim 16 wherein the splines have tapered ends to guide the splines into engagement when the elongated body is moved from compression to tension.

18. A method of releasing a liner running tool from a liner hanger while located at a subterranean location in a wellbore, the method comprising the steps of:

providing the liner running tool with an elongated body and a clutch that is movable into and out of an engaged position in which opposing ends of the running tool are allowed to rotate with respect to each other;

releasably connecting one or the opposing ends of the liner running tool to the liner hanger and a liner to form a liner assembly;

connecting the liner assembly to a tubing string;

inserting the tubing string and the liner assembly into the wellbore and moving the liner assembly to the subterranean location; and releasing the liner running tool from the liner hanger, the releasing step comprising moving the tubing string to apply compression to the liner running tool while simultaneously engaging the clutch and rotating the tubing string in right-hand direction.

19. The method of releasing the liner running tool from the liner hanger of claim 18, wherein, which when the liner running tool is in compression, the clutch is in the engaged position allowing rotation to be transmitted to a release mechanism, and wherein, when the liner running tool is in tension, the clutch is in a disengaged position preventing rotation from being transmitted to the release mechanism but allowing rotation to be transmitted through the liner running tool to the liner.

* * * * *